US007119674B2

(12) United States Patent
Sefton

(10) Patent No.: US 7,119,674 B2
(45) Date of Patent: Oct. 10, 2006

(54) AUTOMATED SITE SECURITY, MONITORING AND ACCESS CONTROL SYSTEM

(75) Inventor: Alan K. Sefton, Knoxville, TN (US)

(73) Assignee: Pips Technology, Inc., Knoxville, TN (US)

( * ) Notice: Subject to any disclaimer, the term of this patent is extended or adjusted under 35 U.S.C. 154(b) by 24 days.

(21) Appl. No.: 10/852,003

(22) Filed: May 21, 2004

(65) Prior Publication Data

US 2004/0233036 A1 Nov. 25, 2004

Related U.S. Application Data

(60) Provisional application No. 60/472,537, filed on May 22, 2003.

(51) Int. Cl.
*G08B 19/00* (2006.01)

(52) U.S. Cl. ..... 340/521; 340/932.2; 340/937

(58) Field of Classification Search ..... 340/932.2, 340/521, 937
See application file for complete search history.

(56) References Cited

U.S. PATENT DOCUMENTS 4,603,390 A 7/1986 Mehdipour et al.
5,034,739 A * 7/1991 Gruhl ..... 340/932.2
5,381,155 A 1/1995 Gerber
5,805,209 A * 9/1998 Yuge et al. ..... 348/149

(Continued)

*Primary Examiner*—Daryl C Pope
(74) *Attorney, Agent, or Firm*—Luedeka, Neely & Graham

(57) ABSTRACT

The invention provides an apparatus and method for automatic monitoring and control of the ingress and egress of vehicles to and from a secure facility and various areas within the facility. A plurality of cameras, such as infrared-sensitive cameras, captures images of the license plates and/or optically readable passive tags of vehicles traveling into and within the site. The system will also be upgradeable to interface with Electronic Vehicle Identification (EVI) Systems once all vehicles emit such information. Alternatively, the system can be configured to work with RF tags providing ALL vehicles entering the site are issued with such devices and the appropriate sensing technology is installed as part of the site infrastructure. One of the advantages of the system outlined in this application is the use of the vehicle license plate or low cost passive optically readable tag as a unique vehicle identifier.

The system also provides a historical database of license plate information not yet available by any other technological means. A video image processing system, such as a software engine running on a computer processor, detects and extracts a vehicle license plate number (LPN), optically readable passive tag or other such identifying characters, within the captured image of the license plate. Based at least in part on the location of the camera that captured the LPN, the processor stores the LPN with a time-stamp in one or more databases, such as a site LPN database, an in-transit "temporary" LPN database, an employee database, an expected visitor database, a "blacklist" database, a loiterer database, a speeder database, a high-security database, a high-security parking lot database, a normal security parking lot database, and a visitor parking lot database or similar such databases as mandated by the facility. Also, depending at least in part on the location of the camera that captured the LPN and whether the vehicle's LPN is listed in one or more of the above-listed databases, the processor controls the actuation of various barriers or such like devices to allow ingress to and egress from various locations defined throughout the site. The processor also preferably controls information posted on various terminals in the site, such as a Security Portal terminal and a parking lot pay booth terminal and on variable messaging signs at various locations within the site.

23 Claims, 10 Drawing Sheets

U.S. PATENT DOCUMENTS 5,877,969 A * 3/1999 Gerber ..... 705/13
6,340,935 B1 * 1/2002 Hall ..... 340/932.2
6,493,676 B1 * 12/2002 Levy ..... 705/13
6,630,893 B1 * 10/2003 Schuette ..... 340/932.2
6,747,687 B1 6/2004 Alves
RE38,626 E * 10/2004 Kielland ..... 340/937
6,832,728 B1 12/2004 Kennedy
6,885,311 B1 4/2005 Howard et al.
2004/0036573 A1 2/2004 Fitzgobbon et al.

* cited by examiner

AUTOMATED SITE SECURITY, MONITORING AND ACCESS CONTROL SYSTEM

This application claims priority to provisional patent application number 60/472,537 filed May 22, 2003 titled AUTOMATED SITE SECURITY, MONITORING AND ACCESS CONTROL SYSTEM.

FIELD

This invention relates to security systems. More particularly, the invention relates to the use of cameras and other monitoring devices to provide for automated monitoring and access control of vehicular traffic within secured areas.

BACKGROUND

In today's world, there is an ever-growing concern about limiting and controlling access to areas containing highly-sensitive information and personnel, such as Department of Defense and Department of Energy facilities, research laboratories, airports and military installations. There is also concern about protecting the security of students, such as on high school or university campuses. In the private sector, business operations that occupy large areas, such as hotels and resorts, cruise liner terminals, airports, country clubs, container ports, and large multi-level parking facilities, have a need for monitoring and controlling vehicular access to various zones within the area occupied by the business. Security and vehicular access control may also be mandated for private gated communities.

Prior security systems designed to monitor and control access to such facilities have been lacking in many respects. What is required, therefore, is an improved integrated security system for automatically controlling access to secure areas, for monitoring the movements of vehicles that have been granted access to the secure areas and for providing information in real time to both manned and unmanned security locations regarding such access and movements.

SUMMARY

The above requirements and others are met by an apparatus for automatically monitoring and controlling the ingress and egress of vehicles to and from a facility and various areas within. A preferred embodiment of the invention includes a plurality of cameras, such as infrared-sensitive cameras, for capturing images of the license plates of vehicles traveling into the facility, within the facility, and even exiting the facility. The apparatus includes a video image processing system, such as a software engine running on a computer processor, for detecting and extracting a vehicle license plate number (LPN), or other such identifying characters, within the captured image of the license plate. Based at least in part on the location of the camera that captured the LPN, the processor stores the LPN with a time-stamp and other pertinent information in one or more databases. These databases can include but are not limited to, a site LPN database, an in-transit LPN database, an employee database, an expected visitor database, a blacklist database, also known as "license plates of interest", a loiterer database, a speeder database, a high-security database, a high-security parking lot database, a normal security parking lot database, and a visitor parking lot database. Depending on the location of the camera that captured the LPN and whether the vehicle's LPN is listed in one or more of the above-listed databases, the processor controls the activation of various physical barriers to allow ingress to and egress from defined areas throughout the site. The processor controls information posted on various terminals in the site, such as a Security Portal and a parking lot pay booth, and on Variable Messaging Signs (VMS) at various locations within the site.

In one preferred embodiment, the video image processing is performed on processors, such as in personal computers or dedicated image processors networked throughout the site. In an alternative embodiment, the video image processing is performed on a single processor that serves all of the cameras in the site.

The cameras can communicate with the video image processing system and/or the main processor by way of a communication network, such as a local area network (LAN), modem, RF modulator, wide area network (WAN), or global network such as the Internet.

The invention provides an automated system for performing various site security monitoring and site access-control actions based upon the different event types as defined by the user. The invention is an event-driven system activated by a camera reading a license plate and/or a temporary passive tag issued and controlled by the facility. The reading of the license plate is triggered either by the plate being detected within the camera video or by an optional trigger such as a light curtain or embedded loop. Events are processed to update the underlying LPN data held in various databases (or in various tables within a single database). Separate databases are maintained such as the site as a whole, for an employee parking lot, for a high-security parking lot, and for a visitor parking lot. In an alternative embodiment, the LPN information for the various facilities within the site may be stored in a single database. In addition, a loiterer database and speeder database may be created for the respective event types.

In one preferred embodiment, the employee parking lot is split across two levels with respective databases for level 1 and level 2, and the number of unoccupied parking spaces in each level is displayed on variable message signs.

Preferably, all vehicles entering the site are recorded on the site database. Vehicles in the employee parking lot, high-security parking lot or visitor parking lot are entered in the respective inventory databases. Vehicles which are not in these databases, but which are in the site database, are in transit on the site.

BRIEF DESCRIPTION OF THE DRAWINGS

Further advantages of the invention are apparent by reference to the detailed description when considered in conjunction with the figures which are not to scale so as to more clearly show the details, wherein like reference numbers indicate like elements throughout the several views, and wherein.

DETAILED DESCRIPTION

Figure 1:
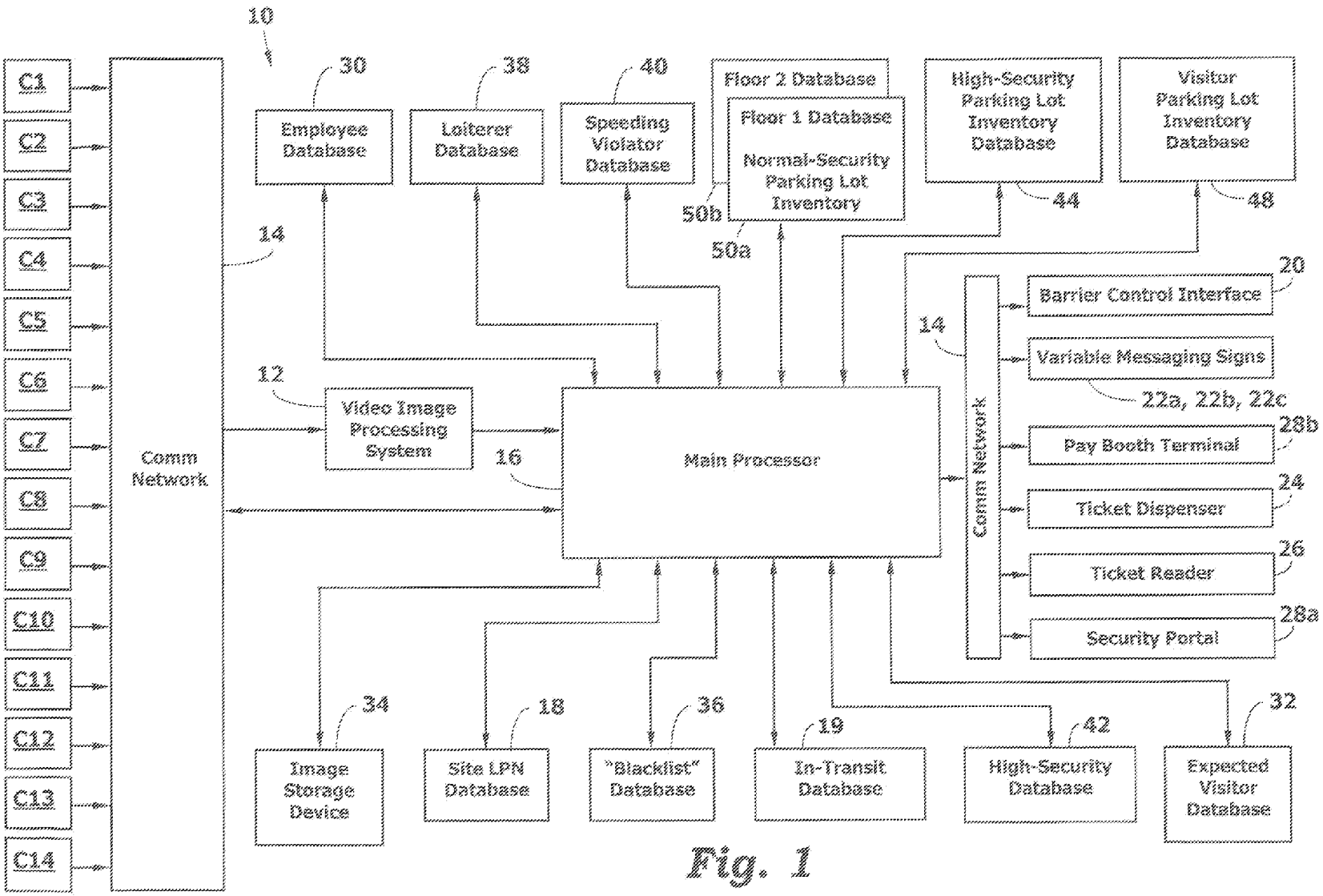
FIG. 1 depicts a functional block diagram of a site security, monitoring, and access control apparatus according to a preferred embodiment of the invention.
Figure 2:
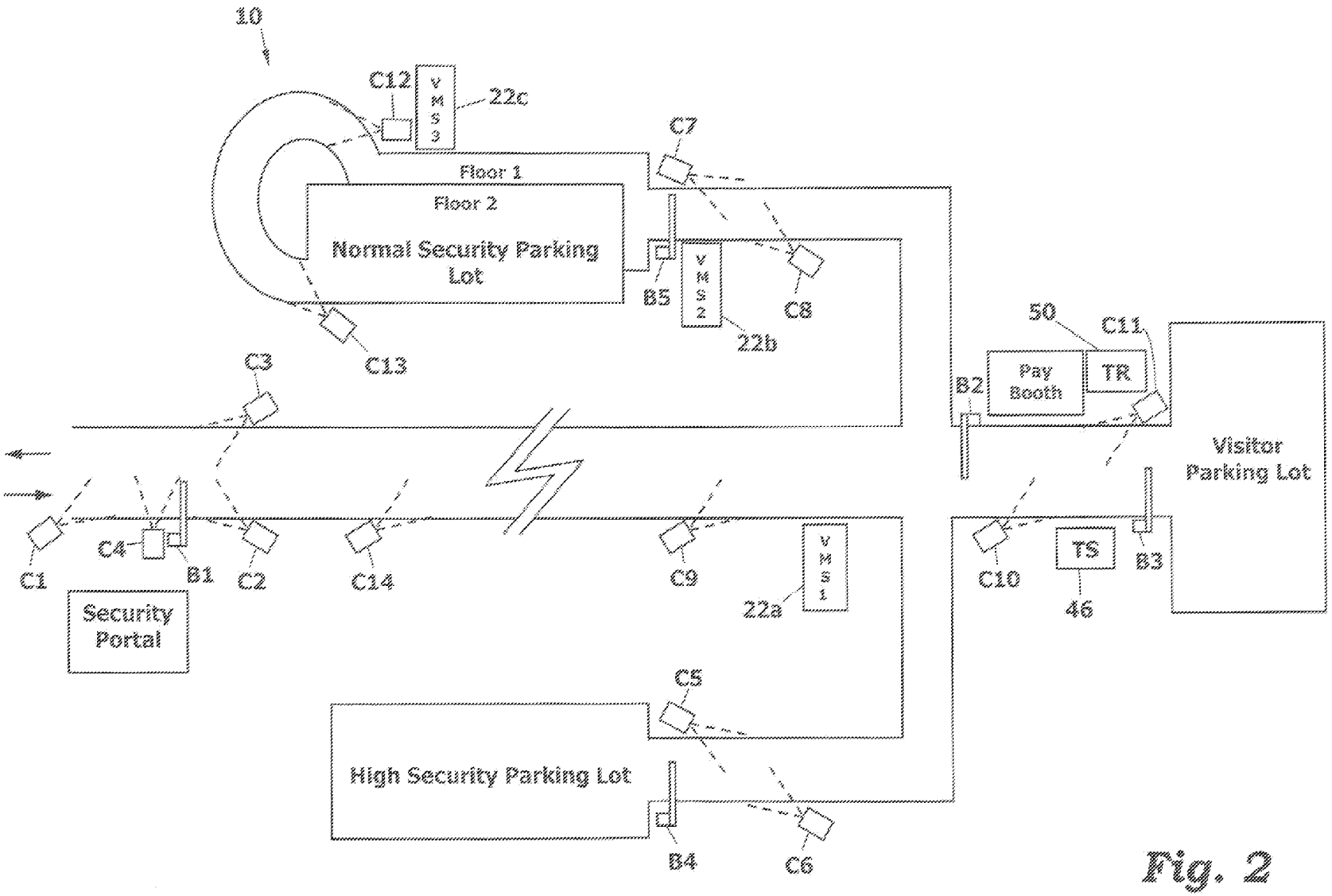
FIG. 2 depicts components of the site security, monitoring, and access control apparatus according to a preferred embodiment of the invention.

Depicted in FIGS. 1 and 2 is an automated system 10 for controlling access to a secure site, such as a military base or high-security research facility, and for monitoring location of vehicles traveling within the site. The system 10 includes a number of monitoring cameras, such as cameras C1–C14 depicted in FIG. 2 for capturing images of license plates, or of a passive tag issued by the facility, of vehicles entering, traveling within and exiting the site. In the preferred embodiment, the cameras C1, C3 and C5–C14, include an integrated infrared emitter for providing infrared illumination to a retro reflective surface on the license plate, such as cameras manufactured by PIPS Technology, Inc. of Knoxville, Tenn. under model numbers P356, P366, or P362. Using infrared illumination, the cameras C1, C3 and C5–C14 will covertly capture a license plate image at night or in the daylight. Where a vehicle does not display a license plate, an alternative passive tag will be issued by the facility and read in the same manner. The cameras C2 and C4 are preferably standard visible-light color video cameras.

Although the cameras C1, C3 and C5–C14 of the preferred embodiment are infrared cameras, the system 10 described herein may also incorporate visible light cameras with appropriate illumination if necessary for license plate image capture. Thus, it will be appreciated that the invention is not limited to any particular type of camera or imaging wavelength.

In the preferred embodiment of the invention, some or all of the cameras C1–C14 are connected to a video image processing system 12 via a communication network 14. The network 14 may be hard-wired, wireless, or fiber optic.

The video image processing system 12 receives video images captured by the cameras C1, C3 and C5–C14, such as images of vehicle license plates, and processes those images to recognize characters within the images, such as the vehicle license plate number (LPN) on the license plate. The video image processing system 12 may include a realtime hardware license plate detector such as described in United Kingdom patent number GB 2,332,322 entitled "Detection of Vehicle License Plates," or a software-based system such as used in the PIPS Technology PC-based "Autoplate" software. The video image processing system 12 provides the LPN to a main processor 16 that performs several functions based on the LPN, as described in more detail hereinafter.

In the embodiment depicted in FIG. 1, the video image processing system 12 is a central system that receives and processes video information from the multiple distributed video cameras C1, C3 and C5–C14. However, it will be appreciated by those skilled in the art that the video information processing could be distributed rather than central. For example, in an alternative embodiment of the invention depicted in FIG. 11, there are separate distributed video image processing systems 12*a*–12*f* associated with the cameras C1, C3 and C5–C14 used to capture vehicle license plate information. In the alternative, a remote processor could handle the input from the cameras. In this alternative embodiment, each of the distributed video image processing systems 12*a*–12*f* extracts the LPN from the license plate image captured by the local camera or cameras, and communicates the LPN, with a time-stamp and other pertinent information to the main processor 16 via the communication network 14. In the distributed system of FIG. 11, the barriers and VMS's are preferably controlled by the remote processors 12*a*–12*f*, such as the processors provided in the model P357 Processor manufactured by PIPS Technology Inc. While using remote processing to control such items as physical barriers, the system 10 could still refer to a central database or databases for the status of the vehicle.

Figure 11:
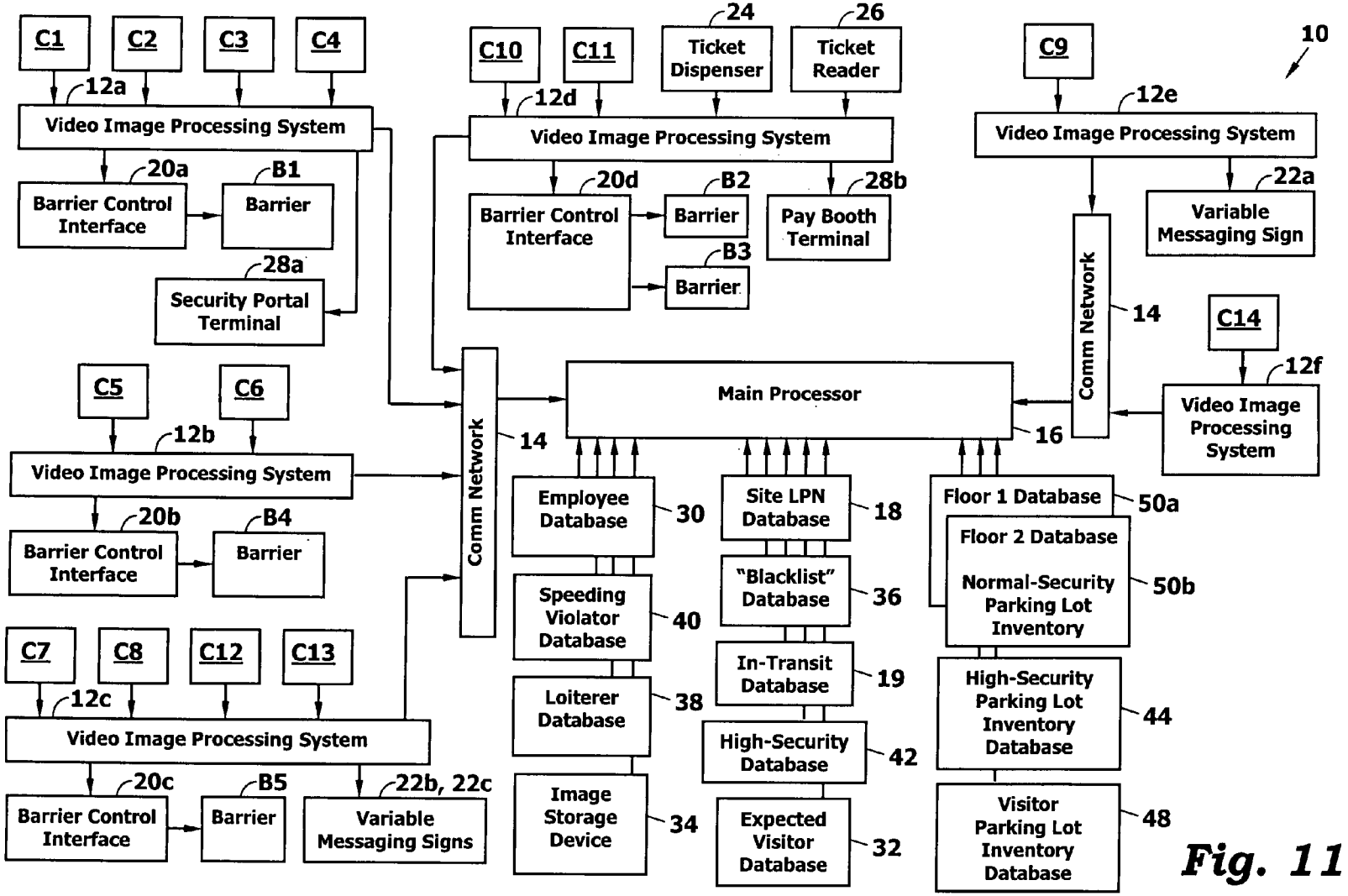
FIG. 11 depicts a functional block diagram of a site security, monitoring, and access control apparatus according to an alternative embodiment of the invention.

The communications infrastructure in such a distributed system requires less bandwidth because less video information is being transmitted over the communication network 14. The examples of system operation described hereinafter may be carried out using the central video image processing system 12 (FIG. 1) or the distributed video image processing systems 12*a*–12*f* (FIG. 11).

The main processor 16 has access to several databases, wherein LPNs are cross-referenced with other pertinent information. For example, as described in more detail below, the Site LPN Database 18 cross-references the LPNs of each and every vehicle that is within the site with the name of the vehicle operator, an image of the vehicle operator, the zones within the site to which the vehicle may have access, the time of the vehicle entry into the site, and other pertinent information. Other of the databases are described hereinafter. These databases are preferably stored on mass storage devices, such as magnetic or optical disks, directly interfaced to and co-located with the main processor 16. Alternatively, the databases may reside on one or more storage devices located remotely from the main processor 16, and accessed by the main processor 16 through the communication network 14.

With reference to FIG. 1, the main processor 16 is connected to one or more barrier control interfaces 20 through the communication network 14. Based on signals provided by the main processor 16, the barrier control interfaces 20 control barriers within the site 10 that may be opened to allow vehicles to proceed into or out of particular zones within the site 10, or closed to impede vehicle movement from one zone to another. Within the site 10 depicted in FIG. 2, there are five barriers B1–B5.

As shown in the preferred embodiment of FIG. 1, the main processor 16 is also connected via the communication network 14 to variable messaging signs (VMS) 22, 24, 26, such as signs manufactured by Addco and other such VMS suppliers. As the name implies, the message displayed on these signs may be changed based upon signals provided by the main processor 16. Exemplary uses of the signs 22, 24, 26 are described in more detail below.

Also connected to the main processor 16 via the communication network 14 are remote communication terminals 28, such as a Security Portal 28*a* and a Pay Booth Terminal 28*b*. As described in more detail hereinafter, the communication terminals 28 are used to communicate information from the main processor 16 to security and other personnel, such as in the Security Portal or Pay Booth. In the preferred embodiment, the communication terminals 28 are personal computers.

Figure 3:
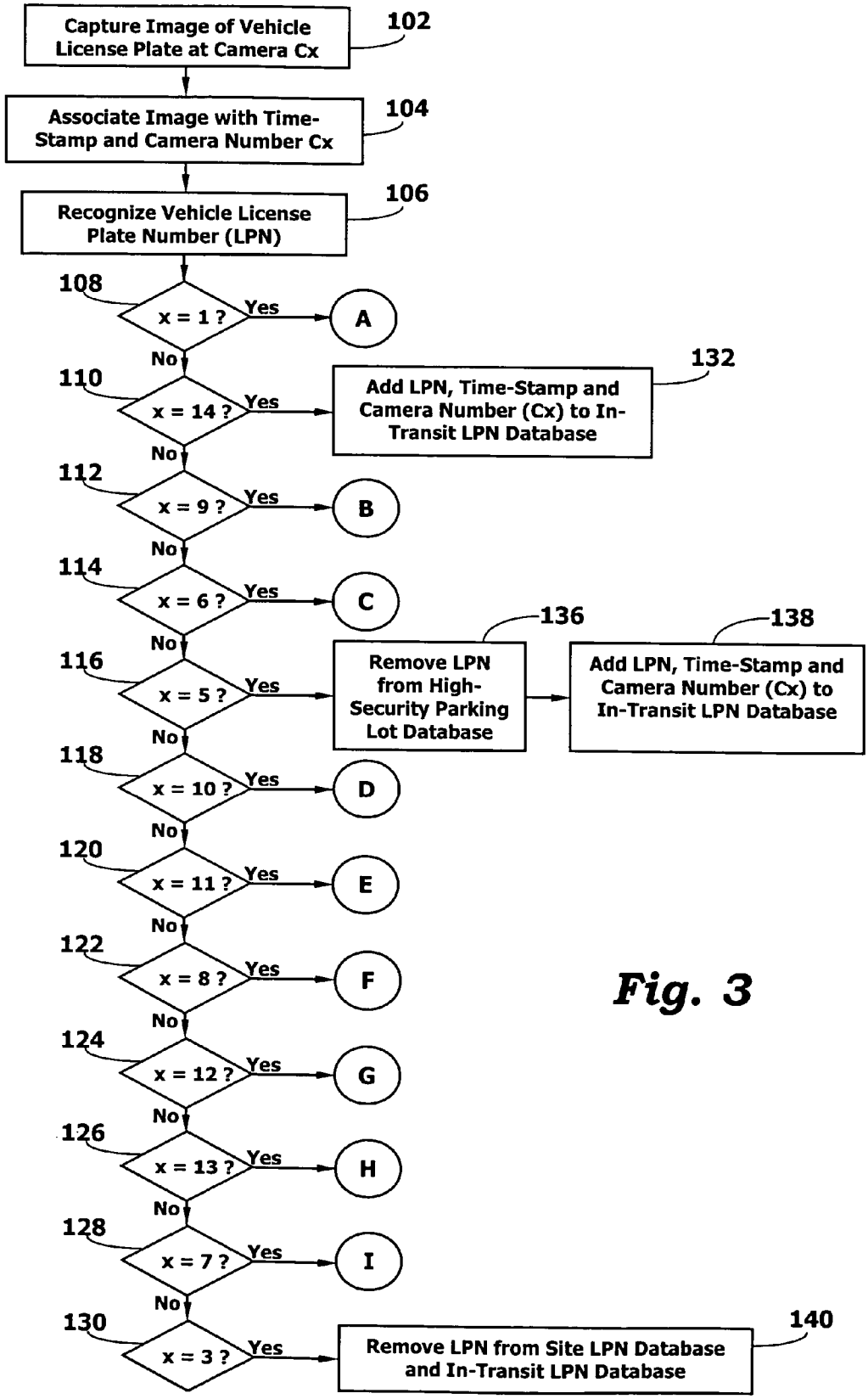
FIGS. 3–10 depict steps in event-driven monitoring and access control processes according to preferred embodiments of the invention.

As depicted in the flow diagram of FIG. 3, various actions performed by the system 10 are triggered by certain events, such as the detection of a vehicle in a particular location on the site. In a distributed system, such as depicted in FIG. 11, a physical presence trigger signal can be connected locally to the local Video Image Processor 12*a*–12*f*, rather than having to be communicated to the central processor.

In a preferred embodiment of the system 10, the presence of a vehicle is sensed by any one of the cameras C1, C3 and C5–C14, such as by detecting a license plate within an image of the vehicle. In other embodiments, the physical presence of a vehicle is sensed by a vehicle presence trigger or sensor, such as a magnetic sensor embedded in the pavement or an infrared sensor. Generally, physical presence sensors are used in the highest security applications, such as in detecting a vehicle approaching the entrance gate. Video triggering alone may be used in lower security applications, such as speed detection. In any event, it will be appreciated by those skilled in the art that either or both types of triggering may be used to initiate a sequence of events as described below, and that the invention is not limited to any particular type of event triggering.

As described in more detail below, once the presence of a vehicle has been detected, the subsequent processing steps preferably depend upon the location of the vehicle in the site. In the preferred embodiment, the location of the vehicle in the site is associated with a particular camera positioned at the location. Thus, in the processing described herein, the processing steps are determined by identification number of the camera at the location where the vehicle is detected.

As depicted in FIGS. 1, 2, and 3, when a vehicle approaches a camera location, the camera captures an image of the vehicle's license plate (step 102). In the preferred embodiment, a time-stamp, camera identifier and other pertinent information are associated with the image of the plate (step 104). Preferably, the time-stamp is information indicating the time and date that the image of the vehicle license plate was captured. The camera identifier is information indicating which camera in the system 10 captured the image of the license plate. For example, the camera identifier may be a TCP/IP address of the camera on the communication network 14. For purposes of this description, the cameras are identified by the reference numbers C1–C14. The image of the plate is transferred to the image processing system 12, such as via the communication network 14, and the image processing system 12 recognizes the characters of the LPN in the image of the plate using character recognition techniques, such as employed in products such as the PIPS Technology Inc. model P357 dedicated Automated License Plate Recognition (ALPR) processor or its "Autoplate" PC based ALPR software. (step 106). The LPN is then associated with the time-stamp, plate image, and other pertinent information.

Figure 4:
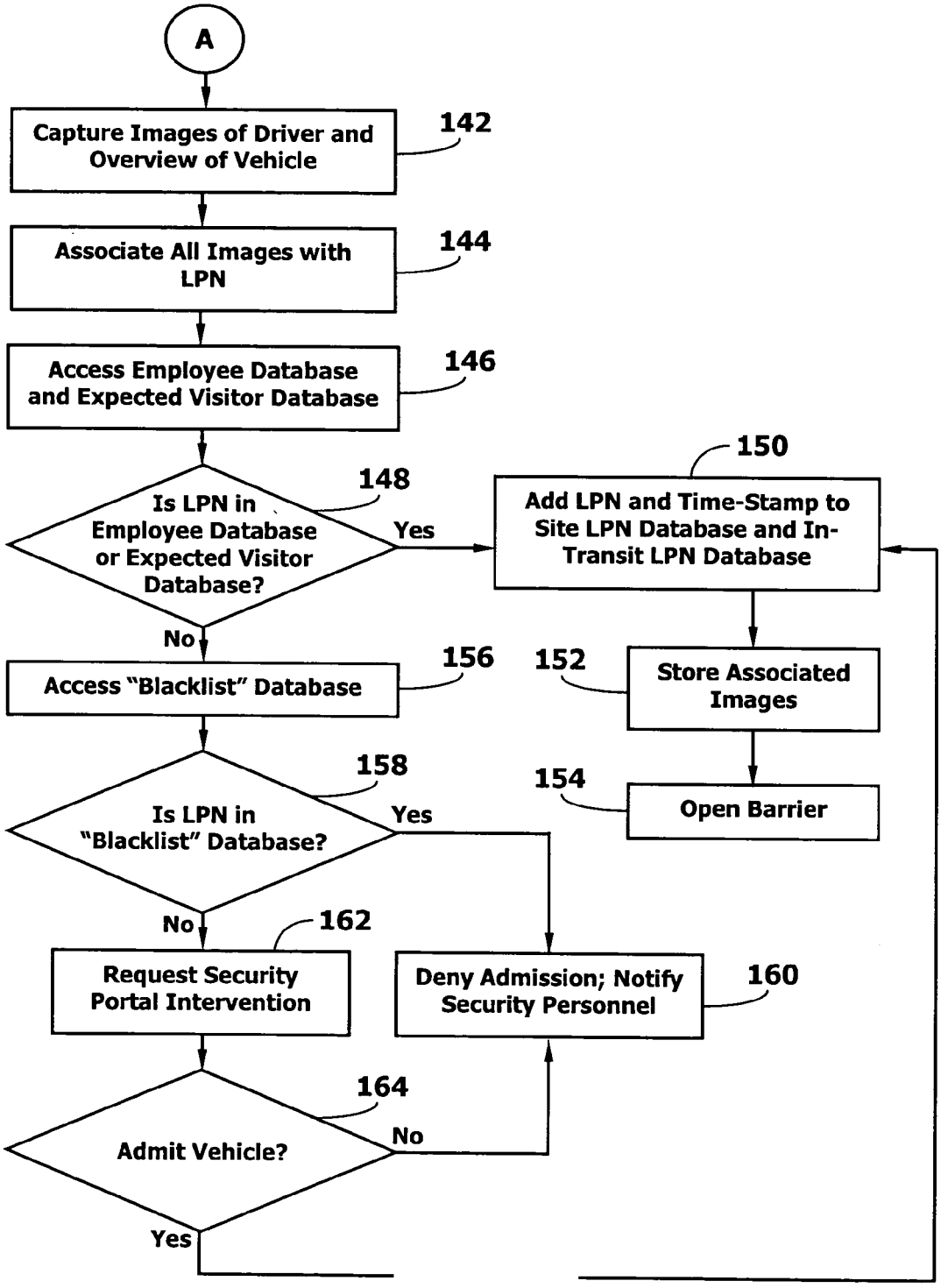

If the location of the vehicle corresponds to camera C1 (step 108), processing continues at point A in the flow diagram of FIG. 4. In the preferred embodiment, cameras C4 and C2 capture images of the driver and the front of the vehicle, respectively (step 142). The images of the vehicle license plate (from camera C1), the driver (from camera C4), and the vehicle overview (from camera C2) are then associated with the LPN (step 144).

As shown in FIG. 1, the system 10 may include an employee LPN database 30 in which the LPNs of all vehicles registered to the site employees are associated with other employee information, such as the employee name, identification number, security clearance level, zones within the site to which the employee may have access and employee photograph. The embodiment of the system may include an expected visitor database 32 in which the LPNs of all vehicles registered to expected visitors are associated with other visitor information, such as the visitor's name, the date of the expected visit, the name of the employee to be visited, and the zone(s) within the site to which the visitor may have access.

If properly engineered, the database entries can provide a full historic record of all significant vehicle movements within the site, so that in the event of an 'incident,' the historic record, including the captured images, can be searched in order to provide evidence of the perpetrator. The system not only provides enhanced security measures, it also can be used as an evidentiary tool enabling historical data to be accessed. As an example, the status of a 'visitor' may not have been correctly identified at the Security Portal.

With continued reference to FIGS. 3 and 4, if the LPN recognized at step 104 is in the employee database 30 or the expected visitor database 32 (steps 146–148), the vehicle will be authorized for admittance to the site. As part of the preferred admission process, the LPN and a time-stamp are added to the site LPN database 18 (step 150) and to an In-Transit LPN database 19. Any additional information from the employee LPN database 30 or the expected visitor database 32 associated with the LPN is preferably stored in the site's LPN database 18. Preferably, images captured by the cameras C4 and C2 are also stored at this time, such as in an image storage device 34, and are associated with the LPN or other identifying information (step 152).

In the preferred embodiment, the barrier B1 is opened in response to a signal communicated from the main processor 16 to the barrier control interface 20 via the communication network 14 (step 154). In this manner, no human intervention is required to raise the barrier B1 and allow entry of the vehicle into the site, if the vehicle's LPN is in the employee LPN database 30 or the expected visitor database 32. Alternatively, the barrier B1 may be opened by a manual control located in the Security Portal.

If the LPN recognized at step 104 is not in the employee database 30 or the expected visitor database 32 (steps 146–148), a "blacklist" database 36 is accessed to determine whether the LPN is stored therein (step 156). The "blacklist" database 36 preferably contains the LPNs associated with vehicles that are to be denied access to the site for any reason determined by the site facility management. For example, the "blacklist" database 36 may include the LPNs of vehicles used previously by persons who have violated security restrictions on the site or by persons known to be wanted by law enforcement officials and/or known or suspected terrorists. This may include both national, international and domestic suspects.

If the LPN recognized at step 104 is in the "blacklist" database 36 (step 158), security personnel are automatically notified (step 160). Preferably, the main processor 16 provides this notification by sending a configurable alert message and/or tone to the Security Portal that will be displayed on a display device 28*a* in the Security Portal. Additionally, an alert message may be e-mailed to security officials, on-site or off-site, who are authorized to be informed or warned that a "blacklisted" vehicle was attempting to enter the site.

If the LPN recognized at step 104 is not in the "blacklist" database 36 (step 158), security personnel in the Security Portal are notified that personal intervention is required (step 162). For example, security personnel may question the driver of the vehicle regarding his or her destination and business on the site, and the employee to be contacted to confirm whether the stated business is legitimate. If the vehicle is to be admitted (step 164), processing preferably continues at step 150. If the vehicle is not to be admitted (step 164), processing preferably continues at step 160.

If the location of the vehicle corresponds to camera C14 (step 110), the LPN, time-stamp, and camera identifier are added to the in-transit LPN database 19 (step 132) to be accessed in subsequent processing.

Figure 5:
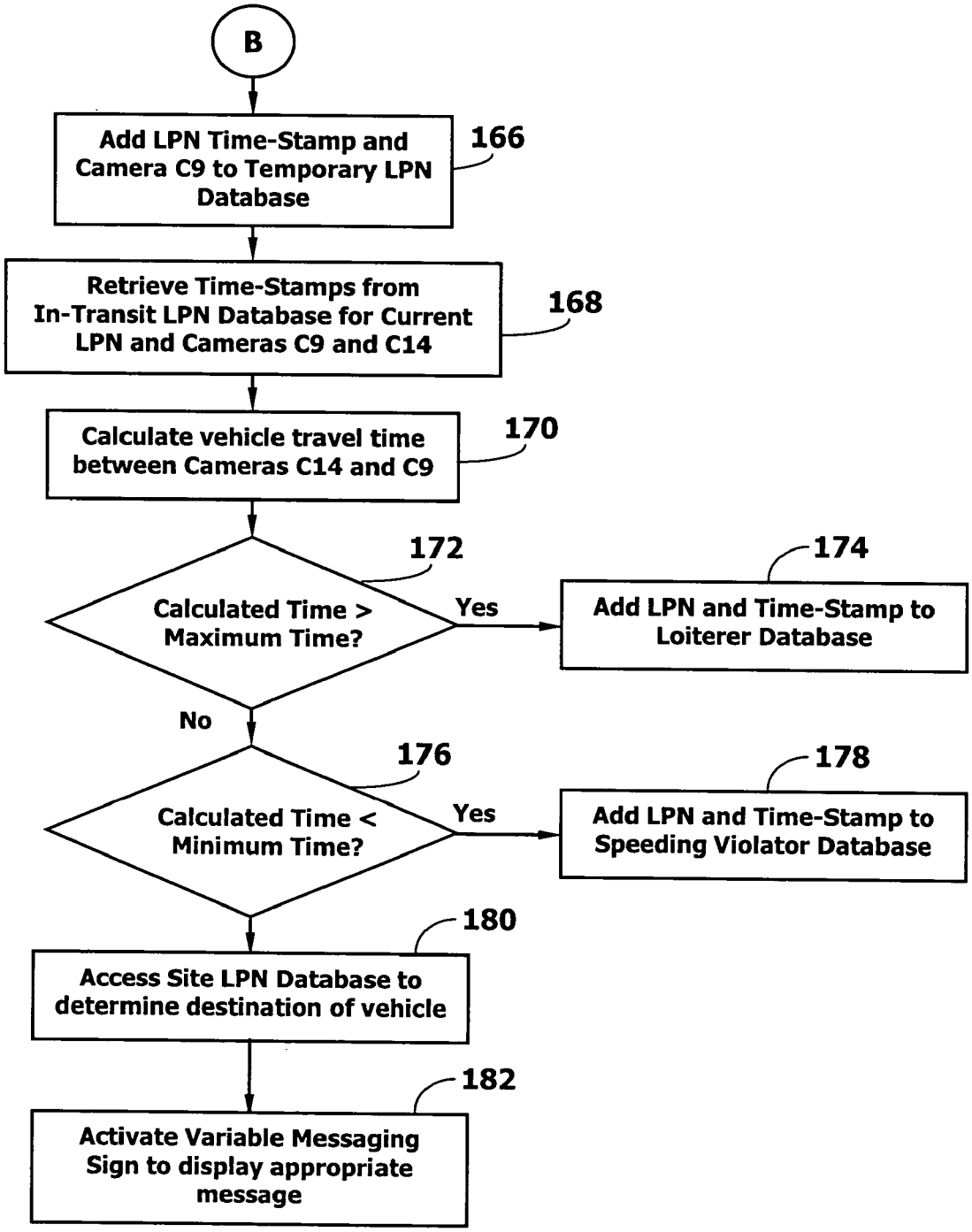

If the location of the vehicle corresponds to camera C9 (step 112), processing continues at point B in the flow diagram of FIG. 5. Preferably, the LPN, time-stamp and camera identifier are added to the in-transit LPN database 19 (step 166). The time-stamps associated with cameras C9 and C14 are retrieved from the in-transit LPN database 19 for the current LPN (step 168), and the time taken for the vehicle to travel from camera C14 to C9 is calculated (step 170). If the vehicle travel time between cameras C14 and C9 is greater than the facility's predetermined maximum time (step 172), then the vehicle is designated as a "loiterer". This may occur, for example, if the operator of the vehicle made an unauthorized stop to take photographs of a sensitive facility at some point between the two cameras. In this situation, the vehicle LPN and time-stamp are added to a loiterer database 38 (step 174). In a preferred embodiment, security personnel are automatically notified when a LPN is added to the loiterer database 38 so that the security personnel may take appropriate action at the appropriate time.

In an alternative embodiment, when a vehicle passes camera C14, or otherwise is detected near the location of camera C14, the LPN, time-stamp, and camera identifier are added to the in-transit LPN database 19. At the same time, a counter or timer begins to measure elapsed time. If a maximum predetermined time elapses before the vehicle is detected at camera C9, the vehicle LPN and time-stamp are added to the "loiterer" database 38 and security personnel are automatically notified.

If the vehicle travel time between cameras C14 and C9 is less than facility's predetermined minimum time (step 176), then the vehicle is designated as a "speeding violator". This may occur, for example, if the vehicle exceeds the posted speed limit on the section of road between the two cameras. In this situation, the vehicle LPN and time-stamp are added to a speeder database 40 (step 178). Preferably, security personnel are automatically notified when a LPN is added to the speeder database 40 so that the security personnel may take appropriate action at the appropriate time. Also, the main processor 16 may generate a notification that is communicated through the communication network 14 to the VMS 22 to notify the operator of the vehicle that the vehicle had been in violation of the posted speed limit.

With continued reference to FIGS. 2 and 5, when the vehicle has been detected at camera C9, the system 10 of the preferred embodiment activates the VMS 22 to provide pertinent information to the driver of the vehicle (step 182). This is preferably accomplished by first accessing the site LPN database 18 to determine the destination of the vehicle within the site (step 180). The VMS 22*a* is then activated to display a message, such as information regarding the vehicle's destination. For example, if the information accessed from the site LPN database indicates that the vehicle is destined for the visitor parking lot, the VMS 22*a* may display directions to that destination.

Figure 6:
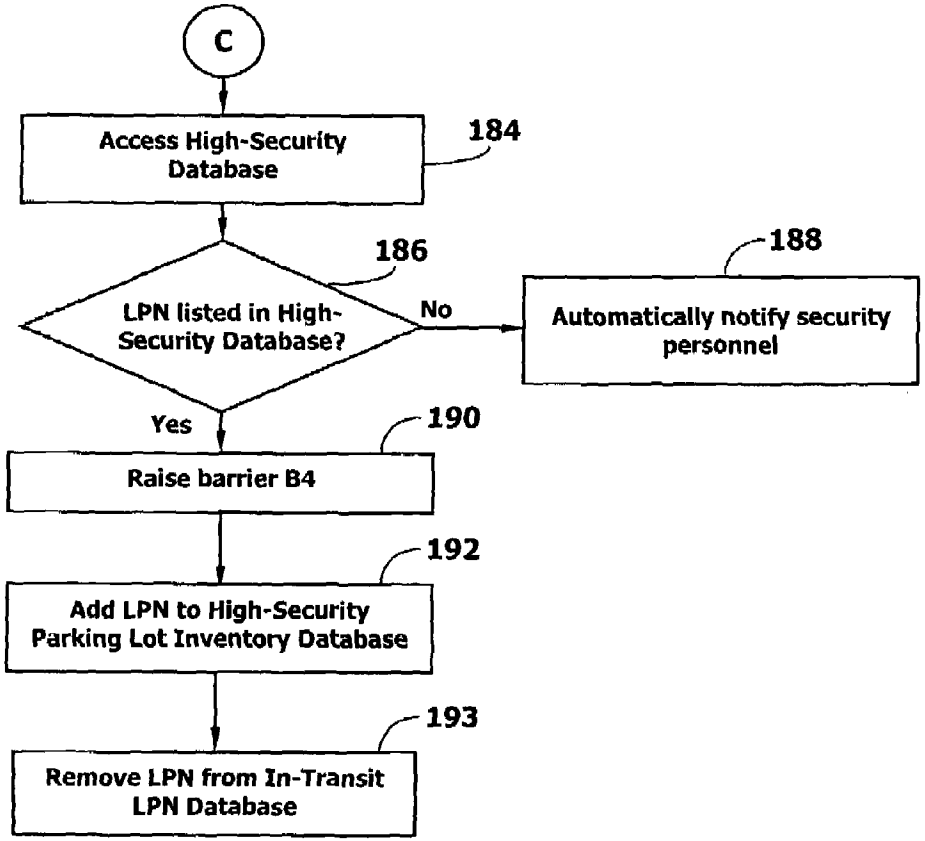

If the location of the vehicle corresponds to camera C6 at the entrance to the high security parking lot (step 114), processing continues at point C in the flow diagram of FIG. 6. In the preferred embodiment, the main processor 16 accesses a high-security database 42 (step, 184), and a determination is made whether the detected LPN, is, listed therein in association with an employee or visitor having a high-security clearance (step 186). If the detected LPN is in the high-security database 42 (step 186), a signal is provided via the barrier control interface 20 to raise the barrier B4 or a like device to allow the vehicle to proceed into the high security parking lot. Preferably, the vehicle's LPN and associated time-stamp are then added to a high security parking lot inventory database 44. If the detected LPN is not in the high-security database 42 (step 186), the vehicle is denied entry into the high security parking lot and security personnel are automatically notified (step 188).

With reference to FIG. 3, if the location of the vehicle corresponds to camera C5 at the exit from the high security parking lot (step 116), the LPN is removed from the high security parking lot inventory database 44 (step 136), and the LPN, time-stamp and camera identifier (such as C5) are added to the in-transit LPN database 19 (step, 138). This process-is repeated so long as the vehicle remains on the monitored facility.

Figure 7:
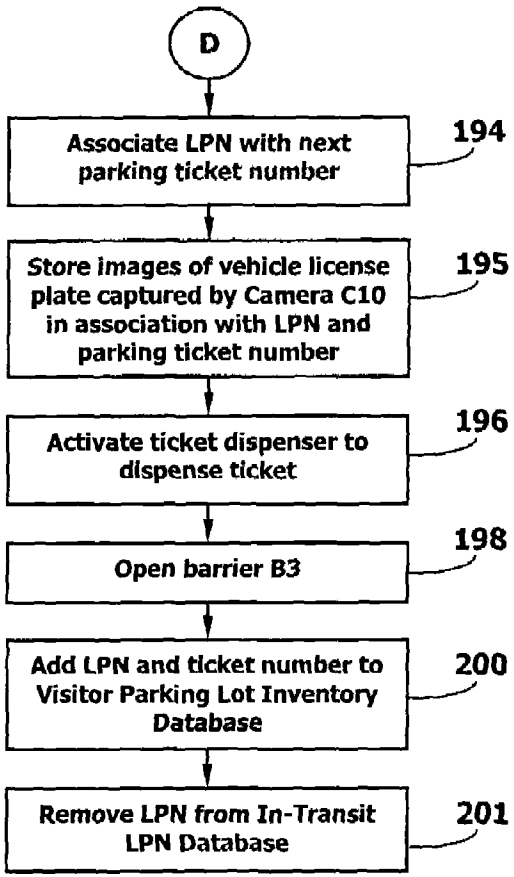

As depicted in the flow chart of FIG. 3, if the location of the vehicle corresponds to camera C10 at the entrance to the visitor parking lot (step 118), processing continues at point D in the flow diagram of FIG. 7. In the preferred embodiment, the detected LPN may be associated with a parking ticket number (step 194), such as the next parking ticket number in a sequence of numbers, and the image of the vehicle license plate captured by the camera C10 is stored in association with the LPN and ticket number (step 195). A parking ticket dispenser 24 is then activated to dispense a parking ticket having printed thereon the parking ticket number associated with the LPN (step 196). In addition to a numeric representation of the ticket number, there is also preferably an encoded version of the ticket number, such as in a bar-code or encoded magnetic stripe. In the preferred embodiment, once the ticket has been removed from the parking ticket dispenser 24, the barrier B3 is raised (step 198), and the LPN, time-stamp, and ticket number are added to the visitor parking lot inventory database 48 (step 200). The processes mentioned herein generally relate to those facilities that utilize automated ticket dispensers as part of their parking control.

Figure 8:
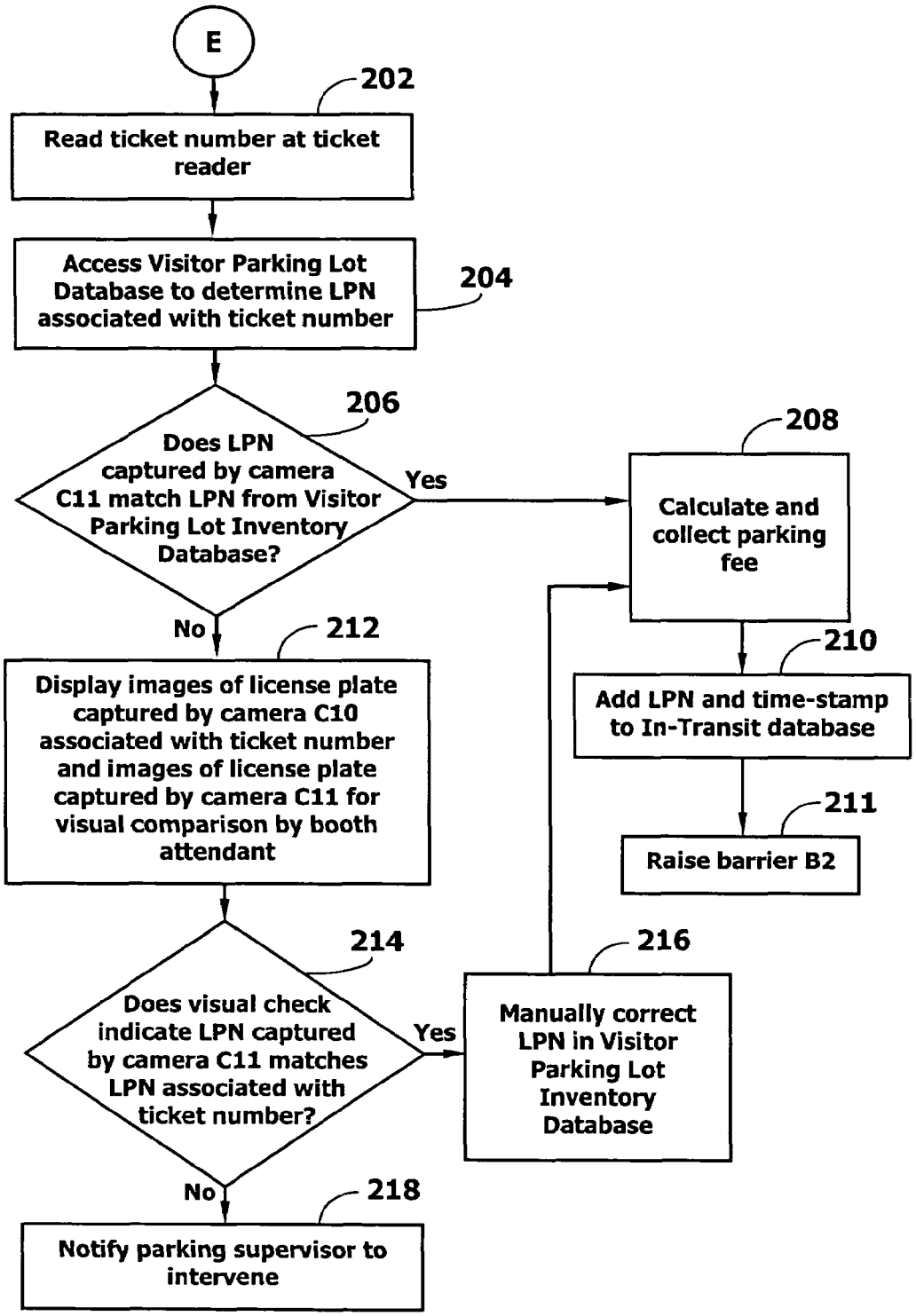

If the location of the vehicle corresponds to camera C11 at the exit from the visitor parking lot (step 120), processing continues at point E in the flow diagram of FIG. 8. The preferred embodiment of the invention includes a ticket reader 26 for receiving the parking ticket from the vehicle operator and for reading the encoded parking ticket number from the parking ticket (step 202). In one preferred embodiment, the ticket reader 26 comprises a bar-code reader. After the ticket number has been read from the parking ticket, the visitor parking lot inventory database 48 is accessed to retrieve the LPN that was associated with the ticket number at the time the ticket was dispensed (step 204). If the LPN retrieved from the visitor parking lot inventory database 48 matches the LPN captured by the camera C11 at the exit from the parking lot (step 206), a parking fee is calculated based upon the duration of stay as computed by the system. The calculated fee becomes due prior to exit (step 208). The LPN and time-stamp are then added to the in-transit LPN database 19 (step 210), and the barrier B2 is raised to allow the vehicle to exit the visitor parking lot (step 211). As outlined in the preceding paragraph, all of these processes lend themselves to commercial applications. Even in this environment, enhanced security will be achieved.

If the LPN retrieved from the visitor parking lot inventory database 48 does not match the LPN captured by the camera C11 at the exit from the parking lot (step 206), the system 10 initiates a process to resolve the mismatch. In the preferred embodiment, the image of the vehicle license plate associated with the ticket number read by the ticket reader 26 is retrieved and displayed at the pay booth terminal 28*b* (step 212). Also displayed at the pay booth terminal 28*b* is the image of the vehicle license plate captured by the camera C11 (step 212). Preferably, the booth attendant will visually compare the two images to determine a match (step 212).

If the visual check indicates that the LPN of the license plate imaged by the camera C11 does not match the LPN of the license plate imaged by the camera C10 that was associated with the ticket number (step 214), the pay booth attendant manually corrects the LPN in the visitor parking lot inventory database 48 to match the LPN shown in the images (step 216). This manual intervention would generally only occur in exceptional circumstances. The LPN and time-stamp are then preferably added to the in-transit LPN database 19 (step 210), and the barrier B2 or like device is actuated to allow the vehicle to exit the visitor parking lot (step 211).

If the visual check indicates that the LPN of the license plate imaged by the camera C11 does not match the LPN of the license plate imaged by the camera C10 that was associated with the ticket number (step 214), the parking supervisor could be notified, preferably automatically such as by email, that personal intervention is necessary (step 218). This situation occurs, for example, if someone attempts to exit the parking lot using a ticket that was dispensed to the driver of another vehicle.

Figure 9:
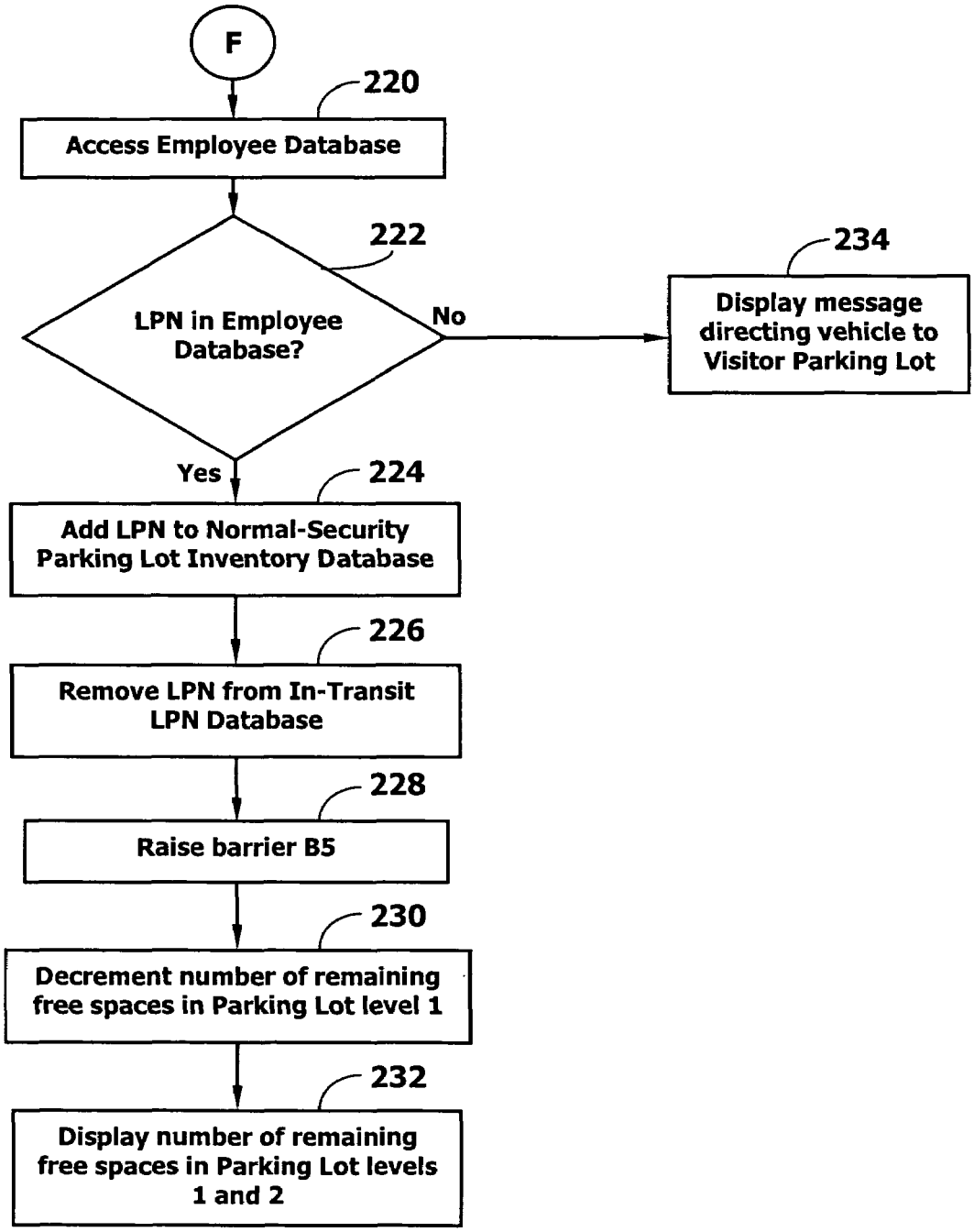

If the location of the vehicle corresponds to camera C8 at the entrance to the normal security parking lot (step 122), processing continues at point F in the flow diagram of FIG. 9. In the preferred embodiment, the main processor 16 accesses the employee database 30 (step 220), and a determination is made whether the detected LPN is listed therein (step 222). If the detected LPN is in the employee database 30 (step 222), the vehicle's LPN and associated time stamp are then preferably added to a normal-security parking lot first level inventory database 50*a* (step 224), and removed from the in-transit LPN database 19 (step 226). A signal is provided via the barrier control interface 20 to actuate the barrier B5 or like device to allow the vehicle to proceed into the normal-security parking lot (step 228). In the preferred embodiment, a value indicating the number of remaining unoccupied parking spaces in level one of the parking lot is decremented (step 230). Preferably, this value is a record stored in the normal-security parking lot first level inventory database 50*a*. The number of unoccupied parking spaces in levels one and two of the normal-security parking lot are then preferably displayed on the VMS 22*b* at the entrance to level one of the normal-security parking lot, and on the VMS 22*c* at the entrance to level two of the normal-security parking lot (step 232). This process would apply regardless of the number of levels available in each parking lot.

If the detected LPN is not in the employee database 30 (step 222), the vehicle is denied entry into the normal-security parking lot by the use of a barrier or like device and an automatic message is displayed on the VMS 22*b* to direct the vehicle to the authorized parking lot (step 234). Security personnel can be automatically notified that an unauthorized vehicle has attempted entry into an unauthorized parking lot.

Figure 10:
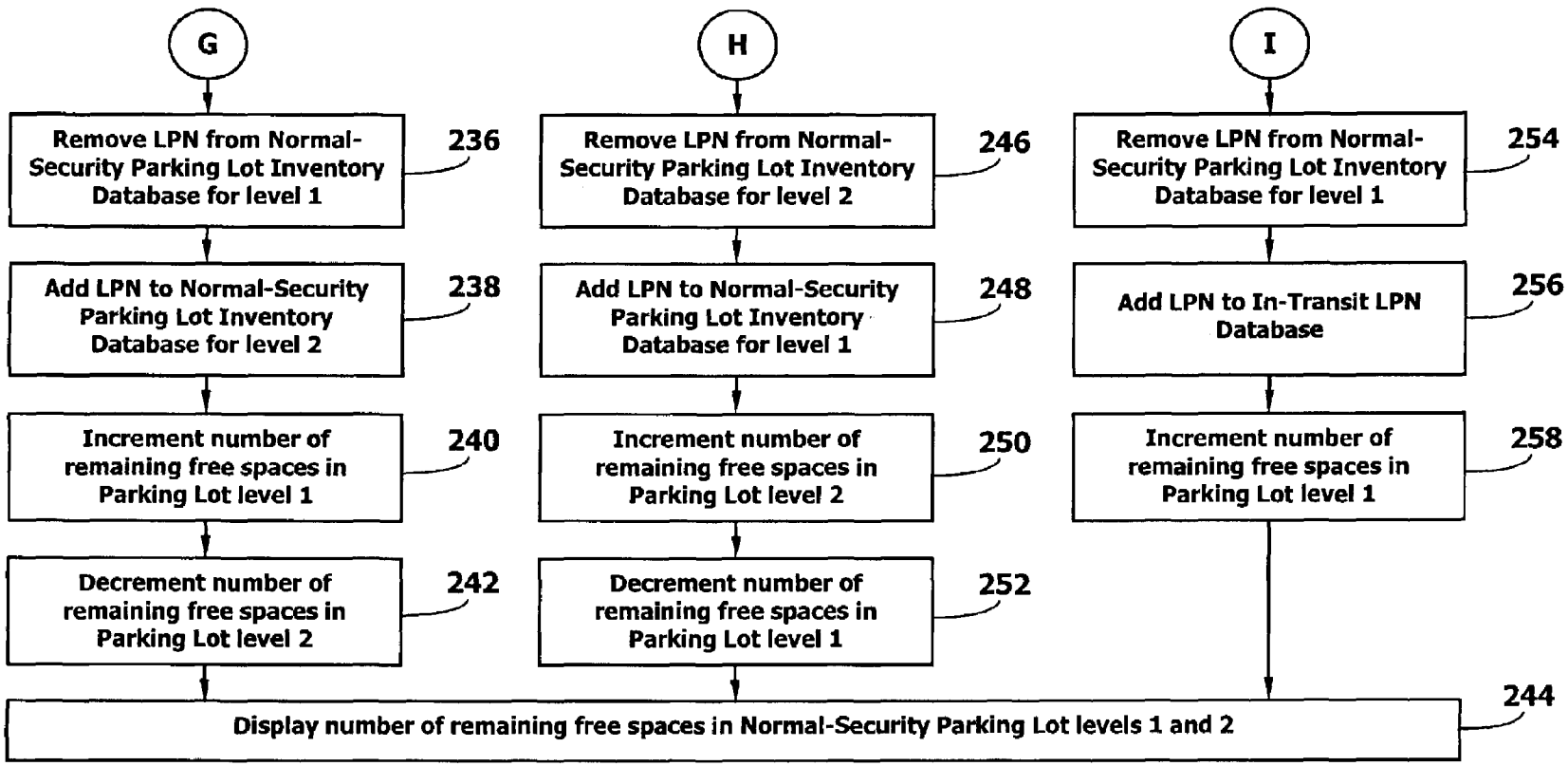

If the location of the vehicle corresponds to camera C12 at the entrance to level two of the normal-security parking lot (step 124), processing continues at point G in the flow diagram of FIG. 10. In the preferred embodiment, the vehicle's LPN and associated time stamp are preferably removed from the normal-security parking lot first level inventory database 50*a* (step 236), and added to the normal-security parking lot second level inventory database 50*b* (step 238). Preferably, the value indicating the number of unoccupied parking spaces in level one of the parking lot is incremented (step 240), and a value indicating the number of unoccupied parking spaces in level two of the parking lot is decremented (step 242). In the preferred embodiment, the value indicating the number of unoccupied parking spaces in level two of the parking lot is a record stored in the normal-security parking lot second level inventory database 50*b*. The number of unoccupied parking spaces in levels one and two of the normal-security parking lot are then preferably displayed on the VMS 22*b* at the entrance to level one of the normal-security parking lot, and on the VMS 22*c* at the entrance to level two of the normal-security parking lot (step 244).

If the location of the vehicle corresponds to camera C13 at the exit from level two of the normal-security parking lot (step 126), processing continues at point H in the flow diagram of FIG. 10. In the preferred embodiment, the vehicle's LPN and associated time stamp are preferably removed from the normal-security parking lot second level inventory database 50*b* (step 246), and added to the normal-security parking lot first level inventory database 50*a* (step 248). Preferably, the value indicating the number of unoccupied parking spaces in level two of the parking lot is incremented (step 250), and a value indicating the number of unoccupied parking spaces in level one of the parking lot is decremented (step 252). Again, the number of unoccupied parking spaces in levels one and two of the normal-security parking lots are then preferably displayed on the VMS's 22*b* and 22*c* (step 244).

If the location of the vehicle corresponds to camera C7 at the exit from level one of the normal-security parking lot (step 128), processing continues at point I in the flow diagram of FIG. 10. In the preferred embodiment, the vehicle's LPN and associated time stamp are preferably removed from the normal-security parking lot first level inventory database 50*a* (step 254), and added to the in-transit LPN database 19 (step 256). Preferably, the value indicating the number of unoccupied parking spaces in level one of the parking lot is incremented (step 258) and the number of unoccupied parking spaces in levels one and two of the normal-security parking lot are displayed on the VMS 22*b* and 22*c* (step 244). If the location of the vehicle corresponds to camera C3 at the exit from the site (step 130), the vehicle's LPN is preferably removed from the site LPN database 18 and the in-transit LPN database 19 (step 140).

The foregoing description of preferred embodiments for this invention have been presented for purposes of illustration and description. Obvious modifications or variations are possible in light of the above teachings and illustrations. The embodiments are chosen and described in an effort to provide the best illustrations of the principles of the invention and its practical application, and to thereby enable one of ordinary skill in the art to utilize the invention in various embodiments and with various modifications as is suited to the particular use contemplated.

The invention claimed is:

1. An access control and monitoring system for monitoring and controlling access of vehicles within a facility, the system comprising:

a plurality of video imaging devices distributed in the facility for capturing images of indicia on one or more of the vehicles;

a video image processing system in communication with the plurality of imaging devices for operating on the images of the indicia to identify one or more characters therein;

an admissible vehicle database for storing characters associated with vehicles that have prior authorization to enter the facility;

a processor in communication with the video imaging processing system and the admissible vehicle database for receiving the characters identified by the video image processing system and accessing the admissible vehicle database to determine whether the identified characters correspond to characters associated with vehicles that have prior authorization to enter the facility; and a communication network for providing communication between the processor and one or more of the video imaging devices, video image processing system, and admissible vehicle database.

2. The access control and monitoring system of claim 1 further comprising:

a barrier control interface in communication with the processor for controlling the operation of one or more barriers that block vehicle access to one or more areas of the facility;

the processor for providing a barrier control signal to the barrier control interface to operate the barrier to provide vehicle access to one or more areas of the facility when the identified characters are associated with a vehicle that has prior authorization to enter the facility; and the communication network for providing communication between the processor and the barrier control interface.

3. The access control and monitoring system of claim 1 further comprising:

an on-site vehicle database for storing information associated with vehicles that have been admitted to the facility; and the processor for providing to the on-site vehicle database information associated with the vehicles that have been admitted to the facility.

4. The access control and monitoring system of claim 1 further comprising:

a blacklist database for storing information associated with vehicles that are to be denied access to the facility;

a security portal for communicating information from the processor to security personnel; and the processor in communication with the blacklist database for accessing the blacklist database to determine whether the identified characters correspond to characters associated with vehicles that are to be denied access to the facility, and for providing information to the security portal to alert the security personnel that a vehicle listed in the blacklist database has attempted to gain access to the facility.

5. The access control and monitoring system of claim 1 further comprising:

an in-transit vehicle database for storing information associated with vehicles that have been admitted to the facility and are in transit between areas within the facility; and the processor for providing to the in-transit vehicle database information associated with the vehicles that have been admitted to the facility and are in transit between areas within the facility.

6. The access control and monitoring system of claim 1 further comprising:

the plurality of video imaging devices including a first imaging device disposed at a first location within the facility and a second imaging device disposed at a second location within the facility, the first imaging device for capturing a first image of the indicia on an in-transit vehicle when the in-transit vehicle passes near the first imaging device at a first time, and the second imaging device for capturing a second image of the indicia on the in-transit vehicle when the in-transit vehicle passes near the second imaging device at a second time;

the video image processing system in communication with the first and second imaging devices for operating on the first and second images of the indicia to identify one or more first characters in the first image and one or more second characters in the second image; and the processor for receiving the first and second characters identified by the video image processing system and associating a first timestamp with the first characters and a second timestamp with the second characters, the processor for determining an in-transit time based on the difference between the first and second timestamp.

7. The access control and monitoring system of claim 6 further comprising:

a speeder database for storing information associated with vehicles that have exceeded the speed limit within the facility; and the processor for generating a speeding alert signal when the in-transit time is less than a predetermined minimum time, communicating the speeding alert signal to a security portal to notify security personnel of a speeding vehicle, and for providing to the speeder database information associated with vehicles that have exceeded the speed limit within the facility.

8. The access control and monitoring system of claim 6 further comprising:

a variable message sign for displaying visual messages to operators of vehicles within the facility, the variable message sign in communication with the processor; and the processor for generating a speeding alert signal when the in-transit time is less than a predetermined minimum time, and communicating the speeding alert signal to the variable message sign to notify an operator of a speeding vehicle that the vehicle has been detected exceeding the speed limit.

9. The access control and monitoring system of claim 6 further comprising:

a loiterer database for storing information associated with vehicles that are determined to have loitered within the facility; and the processor for generating a loitering alert signal when the in-transit time is greater than a predetermined maximum time, communicating the loitering alert signal to a security portal to notify security personnel of a loitering vehicle, and for providing to the loiterer database information associated with vehicles that are determined to have loitered within the facility.

10. The access control and monitoring system of claim 1 further comprising:

the plurality of imaging devices including a first imaging device disposed at an entrance to a parking area within the facility for capturing images of indicia on vehicles entering the parking area, and a second imaging device disposed at an exit to the parking area for capturing images of indicia on vehicles exiting the parking area;

the video image processing system in communication with the first and second imaging devices for operating on the images of the indicia to identify one or more characters therein;

a parking area database for storing characters associated with vehicles that are in the parking area; and the processor for providing to the parking area database information associated with vehicles that have entered the parking area, and for removing from the parking area database information associated with vehicles that have exited the parking area.

11. The access control and monitoring system of claim 10 further comprising:

an in-transit vehicle database for storing information associated with vehicles that have been admitted to the facility but are not in the parking area within the facility; and the processor for removing from the in-transit vehicle database information associated with vehicles that have entered the parking area, and for providing to the in-transit vehicle database information associated with vehicles that have exited the parking area.

12. The access control and monitoring system of claim 10 further comprising:

a variable message sign for displaying visual messages to operators of vehicles within the facility, the variable message sign in communication with the processor; and the processor for maintaining a count of vehicles that are in the parking area at any given time, and communicating information related to the count to the variable message sign to notify an operator of a vehicle regarding a number of available parking spaces in the parking area.

13. A method for monitoring and controlling access of vehicles to areas within a secure facility, the method comprising:

(a) storing character information for identifying vehicles that have prior authorization to enter one or more areas of the facility;

(b) capturing one or more images of indicia on a vehicle seeking access to an area of the facility;

(c) operating on the one or more images captured in step (b) to determine character information there from; and (d) comparing the character information determined in step (c) to the character information stored in step (a).

14. The method of claim 13 further comprising:

(e) controlling the operation of one or more barriers that block vehicle access to one or more areas of the facility;

(f) moving the one or more barriers to allow the vehicle to access the area of the facility when the character information determined in step (c) corresponds to the character information stored in step (a).

15. The method of claim 14 further comprising:

(g) storing character information in an in-transit vehicle database indicating that the vehicle allowed access in step (f) is in transit within the facility;

(h) capturing one or more images of indicia on the vehicle as it enters a parking area of the facility;

(i) operating on the one or more images captured in step (h) to determine character information there from;

(j) comparing the character information determined in step (i) to the character information stored in step (g); and (k) operating on the in-transit vehicle database to indicate that the vehicle having the character information determined in step (i) is no longer in transit within the facility.

16. The method of claim 15 further comprising:

(l) capturing one or more images of indicia on the vehicle as it exits a parking area of the facility;

(m) operating on the one or more images captured in step (l) to determine character information there from;

(n) comparing the character information determined in step (i) to the character information determined in step (m); and (o) operating on the in-transit vehicle database to indicate that the vehicle having the character information determined in step (m) is in transit within the facility.

17. The method of claim 13 further comprising:

(e) storing character information associated with vehicles that are denied access to one or more areas within the facility;

(f) comparing the character information determined in step (c) to the character information stored in step (e);

(g) communicating an alert signal to security personnel when the character information determined in step (c) corresponds to the character information stored in step (e).

18. The method of claim 13 further comprising:

(e) determining an elapsed time between a first capture of indicia on a vehicle at a first location within the facility and a second capture of indicia on the same vehicle at a second location within the facility;

(f) determining whether the vehicle exceeded a speed limit while traveling between the first and second locations based on the elapsed time determined in step (e); and (g) storing violation information associated with the vehicle if the vehicle exceeded the speed limit.

19. The method of claim 18 further comprising (h) sending speeding alert information to security personnel if the vehicle exceeded the speed limit.

20. The method of claim 13 further comprising:

(e) determining an elapsed time between a first capture of indicia on a vehicle at a first location within the facility and a second capture of indicia on the same vehicle at a second location within the facility which is different from the first location;

(f) determining whether the vehicle loitered while traveling between the first and second locations based on the elapsed time determined in step (e); and (g) storing violation information associated with the vehicle if the vehicle loitered between the first and second locations.

21. The method of claim 20 further comprising (h) sending loitering alert information to security personnel if the vehicle loitered within the facility.

22. The method of claim 13 further comprising:

(e) incrementing a count of vehicles in a parking area in the facility when a vehicle enters the parking area;

(f) decrementing the count of vehicles in the parking area when a vehicle exits the parking area;

(g) comparing the count of vehicles in the parking area to a capacity of the parking area;

(h) determining a number of parking spaces available in the parking area based on the comparison of step (g); and (i) displaying to an operator of a vehicle approaching the parking area a message related to the number of parking spaces determined in step (h).

23. An apparatus for monitoring and controlling access of vehicles to areas within a secure facility, the apparatus comprising:

means for storing first character information for identifying vehicles that have prior authorization to enter one or more areas of the facility means for capturing one or more images of indicia on a vehicle seeking access to an area of the facility;

means for operating on the one or more captured images to determine second character information there from; and means for comparing the first character information to the second character information.

* * * * *